US009290348B2

(12) United States Patent
Newhouse et al.

(10) Patent No.: US 9,290,348 B2
(45) Date of Patent: Mar. 22, 2016

(54) OPEN GAP FILM ROLL CORE

(75) Inventors: Kevin B. Newhouse, Houlton, WI (US); Bruce E. Tait, Woodbury, MN (US); Terence A. Lee, Decatur, AL (US); Christopher M. Eastman, Shoals, AL (US); Arlie J. Cecil, Hazel Green, AL (US); Andrew F. Neitzel, Menomonie, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 176 days.

(21) Appl. No.: 13/992,275

(22) PCT Filed: Dec. 15, 2011

(86) PCT No.: PCT/US2011/065155

§ 371 (c)(1),
(2), (4) Date: Jun. 7, 2013

(87) PCT Pub. No.: WO2012/083019

PCT Pub. Date: Jun. 21, 2012

(65) Prior Publication Data

US 2013/0248643 A1 Sep. 26, 2013

Related U.S. Application Data

(60) Provisional application No. 61/424,110, filed on Dec. 17, 2010.

(51) Int. Cl.

| | |
|---|---|
| ***B65H 75/18*** | (2006.01) |
| ***B65H 19/28*** | (2006.01) |
| ***B65H 19/20*** | (2006.01) |
| ***B65H 75/10*** | (2006.01) |
| ***B65H 75/28*** | (2006.01) |

(52) U.S. Cl.

CPC ..... *B65H 19/28* (2013.01); *B65H 19/20* (2013.01); *B65H 19/283* (2013.01); *B65H 75/10* (2013.01); *B65H 75/28* (2013.01)

(58) Field of Classification Search

CPC ..... B65H 75/10; B65H 75/28
USPC ..... 242/610, 610.4, 610.6, 613, 613.1; 156/60

See application file for complete search history.

(56) References Cited

U.S. PATENT DOCUMENTS

| | | | |
|---|---|---|---|
| 3,396,918 | A | 8/1968 | Adamson |
| 4,770,227 | A | 9/1988 | Sporenberg |

(Continued)

FOREIGN PATENT DOCUMENTS

| | | |
|---|---|---|
| DE | 1242073 | 6/1967 |
| DE | 2163485 | 7/1973 |

(Continued)

OTHER PUBLICATIONS

International Search Report for PCT International Application No. PCT/US2011/065155, Mailed on Jul. 3, 2012, 6 pages.

*Primary Examiner* — Sang Kim
(74) *Attorney, Agent, or Firm* — Yen T. Florczak

(57) ABSTRACT

The disclosure generally relates to a film roll core used for winding a polymeric film around, an apparatus for winding the polymeric film on the film roll core, a process of winding the polymeric film on the film roll core, and a rolled film on the film roll core. The disclosure more particularly relates to an open gap film roll core that is capable of reducing defects in wound films.

9 Claims, 6 Drawing Sheets

(56) References Cited

U.S. PATENT DOCUMENTS

| | | | | |
|---|---|---|---|---|
| 5,499,781 | A | 3/1996 | Reinke | |
| 5,646,090 | A | 7/1997 | Tamura | |
| 5,908,173 | A | 6/1999 | De Roeck | |
| 6,123,286 | A | 9/2000 | Garcia | |
| 6,443,387 | B1 | 9/2002 | Mercer | |
| 7,562,841 | B2 * | 7/2009 | Holden et al. | 242/610.1 |
| 2002/0190152 | A1 | 12/2002 | Harikawa | |
| 2006/0214049 | A1 | 9/2006 | Hernandez | |
| 2008/0135672 | A1 | 6/2008 | Fabian | |
| 2009/0054219 | A1 * | 2/2009 | Wu | 492/22 |
| 2009/0087600 | A1 * | 4/2009 | McFarland et al. | 428/34.2 |

FOREIGN PATENT DOCUMENTS

| | | |
|---|---|---|
| DE | 3314489 | 10/1984 |
| DE | 3644950 | 3/1988 |
| DE | 4206143 | 9/1993 |
| DE | 20317826 | 2/2004 |
| EP | 0535328 | 4/1993 |
| JP | 2000-318930 | 11/2000 |
| JP | 2003-192237 | 7/2003 |
| JP | 07196260 | 5/2005 |
| JP | 2009-242059 | 10/2009 |
| WO | WO 2005-000494 | 1/2005 |
| WO | WO 2011-091006 | 7/2011 |

* cited by examiner

OPEN GAP FILM ROLL CORE

BACKGROUND

During the process of manufacturing polymeric films such as optical films, the web needs to be wound onto cores to form the rolls of material to be sold. Typically, a cut transfer process is used to begin winding the web onto the core. In a cut transfer process, the starting end of the web is adhered to a core using a strip of adhesive tape, or a strip of doubled sided adhesive tape. Because of this attachment scheme, the leading edge of the web is over-lapped by the subsequent layers of wound web, and causes an effective disparity on the core surface which can increase the stress in adjacent web layers. This disparity can propagate impressions to several adjacent layers of the web, causing defects that are often referred to as core impressions. These core impressions can be observed on many of the initial layers of wound web material on each roll, and can be considered as wasted product.

SUMMARY

The disclosure generally relates to a film roll core used for winding a polymeric film around, an apparatus for winding the polymeric film on the film roll core, a process of winding the polymeric film on the film roll core, and a rolled film on the film roll core. The disclosure more particularly relates to an open gap film roll core that is capable of reducing defects in wound films. In one aspect, the present disclosure provides a film roll core that includes a cylindrical tube having an outer surface; a compliant layer disposed on the outer surface; and a longitudinal gap in the compliant layer, the longitudinal gap having a gap width sufficient to position a film edge within the longitudinal gap.

In another aspect, the present disclosure provides a film winding apparatus that includes a film roll core having: an outer surface; a compliant layer disposed on the outer surface; a longitudinal gap in the compliant layer having a gap width sufficient to accommodate a film edge; and a cut and transfer system capable of cutting a film substrate and transferring a severed edge of the film substrate into the longitudinal gap, wherein the film substrate is disposed tangentially adjacent the outer surface, and the film substrate width is substantially parallel to a central axis of the film roll core.

In yet another aspect, the present disclosure provides a method of winding film that includes disposing a film substrate tangentially adjacent to a film roll core and moving the film substrate past the film roll core. The film roll core includes an outer surface; a compliant layer disposed on the outer surface; and a longitudinal gap in the compliant layer having a gap width sufficient to accommodate a film edge. The method of winding film further includes rotating the film roll core about a central axis such that the longitudinal gap and the film substrate approach each other; activating a knife edge slitter to sever the film substrate, thereby forming a severed film edge along a width of the film substrate; and activating a transfer device to dispose the severed film edge into the longitudinal gap.

In yet another aspect, the present disclosure provides a roll of film that includes a film core and a web of film wound around the film core. The film core includes a cylindrical tube having an outer surface; a compliant layer disposed on the outer surface; and a longitudinal gap in the compliant layer. Further, a first film edge of the web of film is disposed within the longitudinal gap such that subsequently wound layers of the web of film include minimal impressions of the first film edge.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The disclosure describes an article and a process to reduce the core impressions created by the starting end of a web on the adjacent web layers next to the core. In one particular embodiment, the present disclosure can lead to a reduction in the amount and severity of such core impressions on a wound polymeric film, by reducing the amount of stress in adjacent layers of wound web. The article can be described as an open gap film roll core that provides an attachment location for the starting end of a web, such that the starting end imparts minimal stress on a subsequent wound film layer.

In one particular embodiment, the open gap film roll can be fabricated by partially wrapping a film core with a thin foam sheet. The thin foam sheet can be fabricated from a material which is compliant and conformable, and has an adhesive layer on a major surface to adhere the thin foam sheet to the core. The opposing major surface can have a tacky adhesive coating which can be used to adhere the starting end of the web to the thin foam sheet. The thin foam sheet can be wrapped around the core to form a small gap disposed axially along the core face. A web can be transferred to the core by a cut transfer process that precisely cuts the web, and places the starting end of the web in the small gap. Because of the compliant thin foam sheet and the gap, the compressive effect of subsequent layers of film being wound onto the roll causes the starting end of the web to compress the portion of the compliant thin foam sheet on which it lies. This causes the starting end of the web to fall to (or below) the surface of the foam on the opposite side of the gap, so the next layer of wound web covers the starting web end, and may minimize stresses.

These minimized stresses can reduce core impressions on the adjacent web layers, and as a result improve the yield of web processing lines by reducing waste.

Figure 1A:
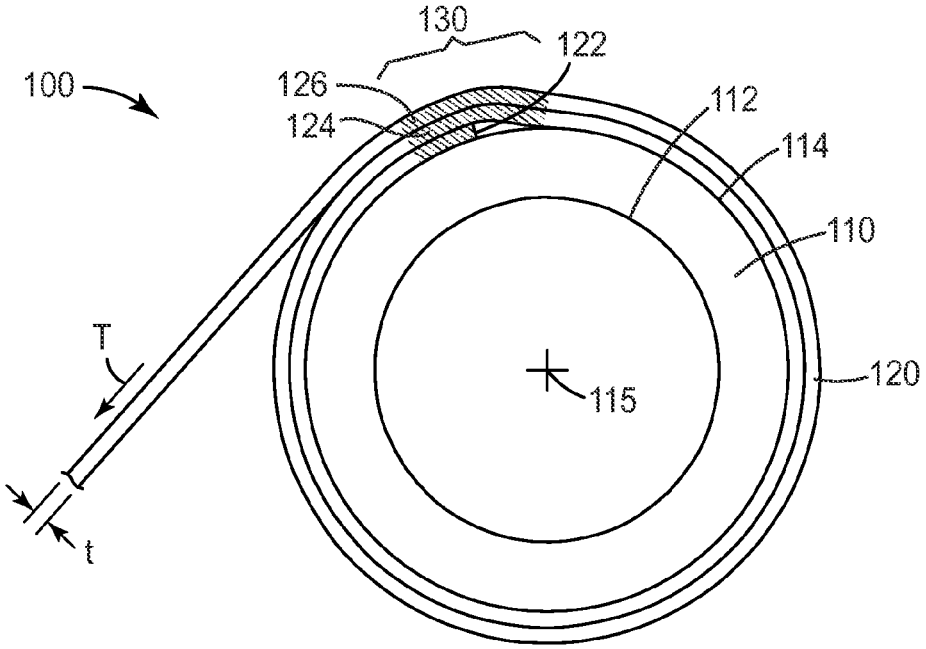
FIG. 1A Prior Art
FIGS. 1A-1B shows a cross-sectional schematic of a prior art film roll core.

FIG. 1A shows a cross-sectional schematic of a prior art film roll core 100. In FIG. 1A, prior art film roll core 100 includes a cylindrical tube 110 having an inside surface 112, an outside surface 114 and a center of rotation 115. Inside surface 112 is typically mounted on the mandrel of a film winding apparatus (not shown). A starting end 122 of a polymeric film 120 is disposed on the outside surface 114 of the cylindrical tube 110, and the polymeric film 120 is wound around the cylindrical tube 110. The starting end 122 of the polymeric film 120 may be attached to the core using an adhesive layer coated on the outside surface 114 of the core, or by a double-sided adhesive tape (not shown). A region of increased stress 130 is generated by the tension "T" applied to the polymeric film 120 as a first wrap overlap 124 of polymeric film 120 overlays the starting end 122. The region of increased stress 130 can result in a visible deformation in the polymeric film. The first wrap overlap 124 generally follows the contour of the surface over which it is wrapped, and the starting end 122 generates a step-change in the outside surface 114 of the cylindrical tube, corresponding to the thickness "t" of the polymeric film. A subsequent second wrap overlap 126 overlays the first wrap overlap 124 and the starting end 122, again resulting in a visible deformation in the polymeric film 120 in the region of increased stress 130.

Figure 1B:
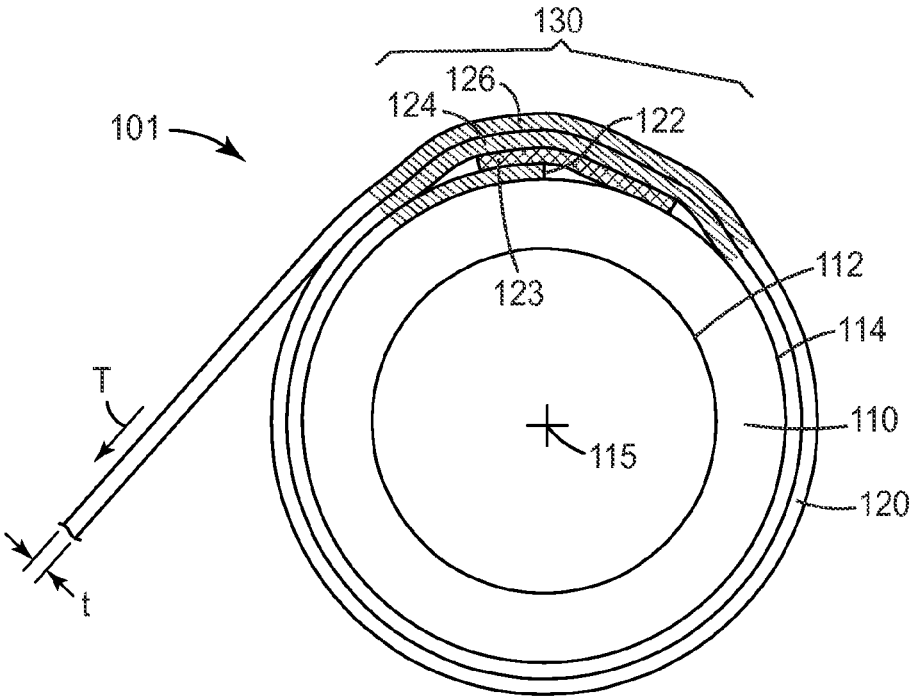
FIG. 1B Prior Art

FIG. 1B shows a cross-sectional schematic of a prior art film roll core 101. In FIG. 1B, prior art film roll core 101 includes a cylindrical tube 110 having an inside surface 112, an outside surface 114 and a center of rotation 115. Inside surface 112 is typically mounted on the mandrel of a film winding apparatus (not shown). A starting end 122 of a polymeric film 120 is disposed on the outside surface 114 of the cylindrical tube 110, and the polymeric film 120 is wound around the cylindrical tube 110. The starting end 122 of the polymeric film 120 can be attached to the core using an adhesive tape 123 on the outside surface 114 of the core. A region of increased stress 130 is generated by the tension "T" applied to the polymeric film 120 as a first wrap overlap 124 of polymeric film 120 overlays the starting end 122 and the adhesive tape 123. The region of increased stress 130 can result in a visible deformation in the polymeric film. The first wrap overlap 124 generally follows the contour of the surface over which it is wrapped, and the starting end 122 generates a step-change in the outside surface 114 of the cylindrical tube, corresponding to the thickness "t" of the polymeric film, as well as a second step-change in the outer surface corresponding to the thickness of the adhesive tape 123. A subsequent second wrap overlap 126 overlays the first wrap overlap 124, the starting end 122, and the adhesive tape 123, again resulting in a visible deformation in the polymeric film 120 in the region of increased stress 130.

Figure 2A:
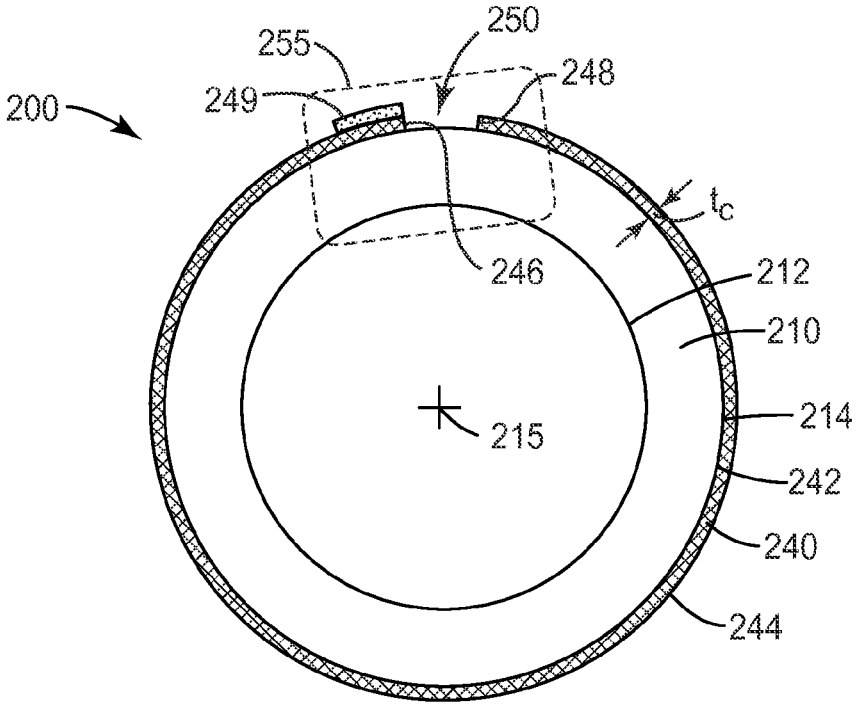
FIGS. 2A-2B shows a cross-sectional schematic of an open gap film roll core.
Figure 2B:
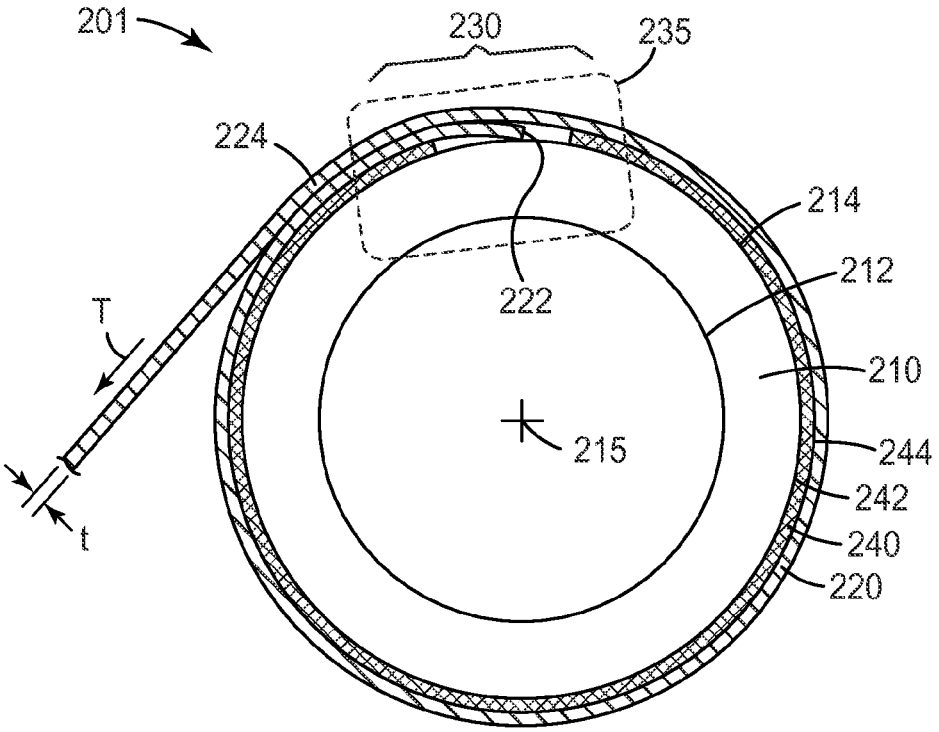

FIGS. 2A-2B shows a cross-sectional schematic of an open gap film roll core 200, according to one aspect of the disclosure. In FIG. 2A, open gap film roll core 200 includes a cylindrical tube 210 having an inside surface 212, an outside surface 214 and a center of rotation 215. Inside surface 212 is typically mounted on the mandrel of a film winding apparatus (not shown). The cylindrical tube 210 can be fabricated from any material suitable to support the winding of film, such as a metal, plastic, paper, a composite, and the like. Generally, the cylindrical tube 210 is a disposable item, and as such is typically made from an inexpensive material such as cardboard.

A compliant layer 240 is disposed on the outside surface 214 of the cylindrical tube 210, such that a gap 250 remains between a first edge 246 and a second edge 248 of the compliant layer 240. The compliant layer 240 can be attached to the outside surface 214 by an adhesive layer (not shown) between the outside surface 214 of the cylindrical tube 210 and the inner compliant surface 242 of the compliant layer 240. A second adhesive layer 249 can be disposed on a portion of an outside compliant surface 244 of the compliant layer 240. In some cases, the second adhesive layer 249 can be disposed on a portion of the outside compliant surface 244 of the compliant layer 240 near the first edge 246 of the compliant layer 240, as shown in FIG. 2A. In some cases, the second adhesive layer 249 can be disposed on any portion, up to and including the entire the outside compliant surface 244 of the compliant layer 240.

The compliant layer 240 can be made from any suitably compliant material that can deform under radial pressures of between about 100 and about 2000 psi. In some cases, the compliant layer 240 can be made from a material such as a polyurethane, a polyethylene, a silicone, or a rubber such as neoprene, and the like. The compliant material may be a foamed material that includes a plurality of voids dispersed throughout the material, such as an open-cell foam or a closed-cell foam, as known in the art. In one particular embodiment, the compliant layer 240 can be a polyethylene foam, such as a 3M™ Cushion-Mount™ plate mounting tape available from 3M Company, St. Paul, Minn. In some cases, 3M™ Cushion-Mount™ E1020 (0.020" (0.508 mm) thick), or E1040 (0.042" (1.067 mm) thick), or E660 (0.070" (1.778 mm) thick) can be used for compliant layer 240.

The compliant layer 240 typically has a compliant layer thickness "$t_c$" of between about 5 mils (0.127 mm) to about 70 mils (1.778 mm), or between about 10 mils (0.254 mm) to about 50 mils (1.27 mm), or between about 20 mils (0.508 mm) to about 40 mils (1.016 mm) In some cases, 20 mils can be a preferable compliant layer thickness; however, the preferred thickness can depend on the thickness of a polymeric film 220 wrapped around the open gap film roll core 200, as described elsewhere. The first and second edges 246, 248, of the compliant layer 240 can be cut in several different ways to adjust the compliancy, and an end gap region 255 is expanded to show these different cuts in FIGS. 3A-3D, as described elsewhere.

In one particular embodiment, the gap 250 can have a width between about 1/16 inches (1.588 mm) and about 3/8 inches (9.525 mm), to accommodate an end of the polymeric film 220. In some cases, the gap 250 is preferably as small as possible, and gaps over 1/4 inch (6.35 mm) in width can make an impression in some polymeric films. A general rule of thumb is to have the smallest gap possible to get the end of the polymeric film 220 to lie within it, and thicker films may enable a wider gap.

The gap 250 is used to accommodate the starting end of the polymeric film to be wound on the film core, and as such, the size and shape of the gap should be adjusted to ensure that the starting end can be readily placed with a high degree of precision, within the gap. In one particular embodiment, the gap 250 can be disposed on the outside surface 214 of the cylindrical tube 210, parallel to the axis of rotation 215. In some cases, the gap 250 can instead be disposed on the outside surface 214 of the cylindrical tube 210 at an angle (not shown) to the axis of rotation 215 (that is, the gap can be a spiral around a portion of the cylindrical tube 210). In some cases, the gap 250 can instead be disposed in a predetermined pattern on the outside surface 214 of the cylindrical tube 210, where the predetermined pattern corresponds to the configuration of the starting (that is, cut) end of the polymeric film.

FIG. 2B shows a cross sectional schematic of a wrapped open gap film roll core 201 according to one aspect of the disclosure. The wrapped open gap film roll core 201 includes the open gap film roll core 200 of FIG. 2A, with a first wrap overlap 224 overlaying first end 222 of polymeric film 220. Polymeric film 220 has a thickness "t", and is wound on open gap film roll core 200 under a web tension "T" that imparts a radial pressure on the compliant foam 240, and particularly in a region of increased stress 230. A compressed end gap region 235 is expanded in FIG. 2C to show changes in the compliant layer 240 that occur due to the first wrap overlap 224, and subsequent overlapping layers.

Figure 2C:
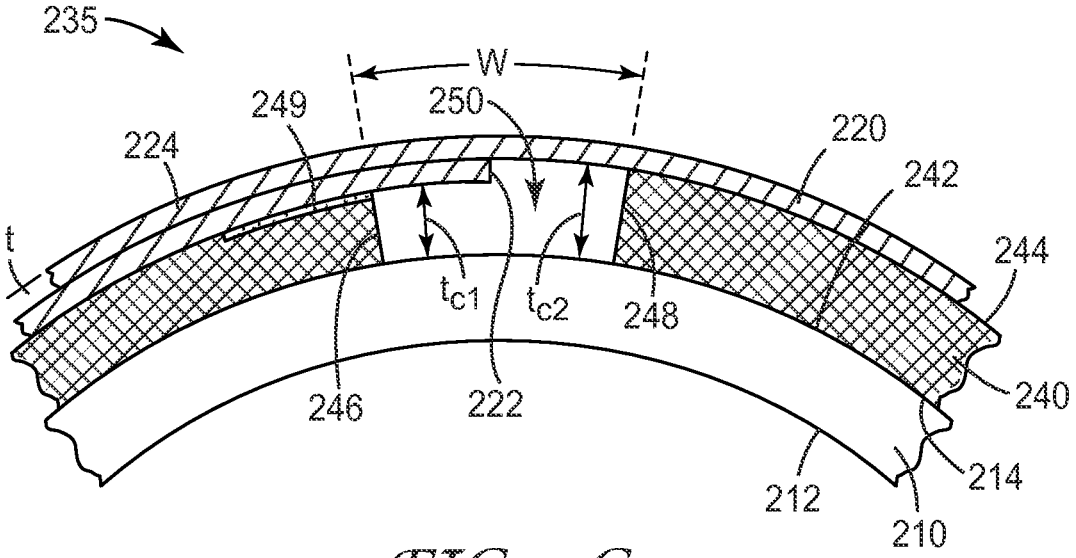
FIG. 2C shows a cross-sectional schematic of a compressed end gap region of FIG. 2B.
Figure 3A:
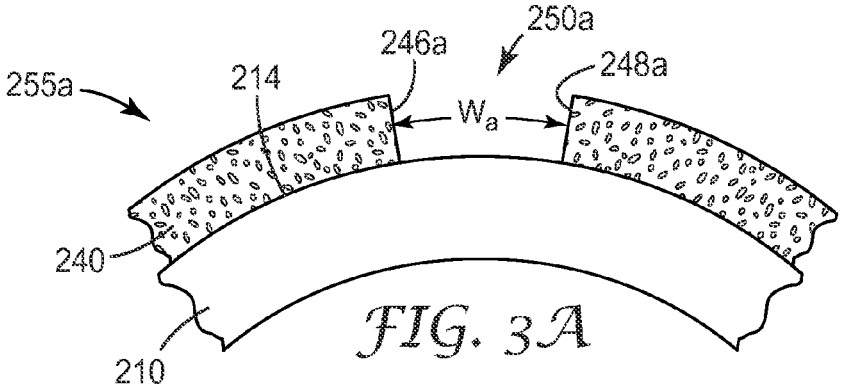
FIGS. 3A-3D shows enlarged embodiments of an end gap region of FIG. 2A.
Figure 3B:
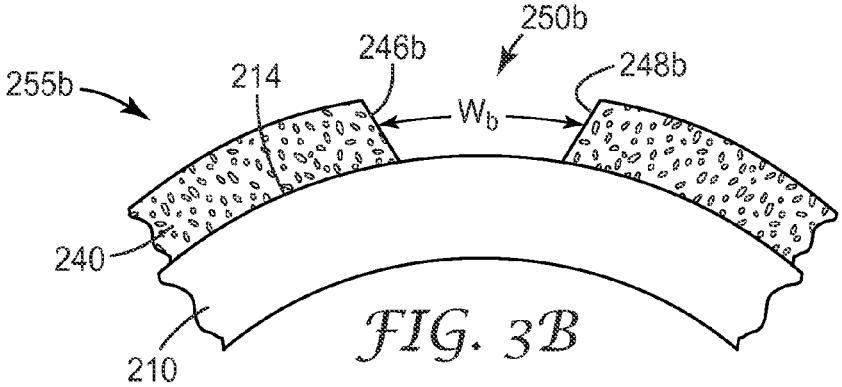
Figure 3C:
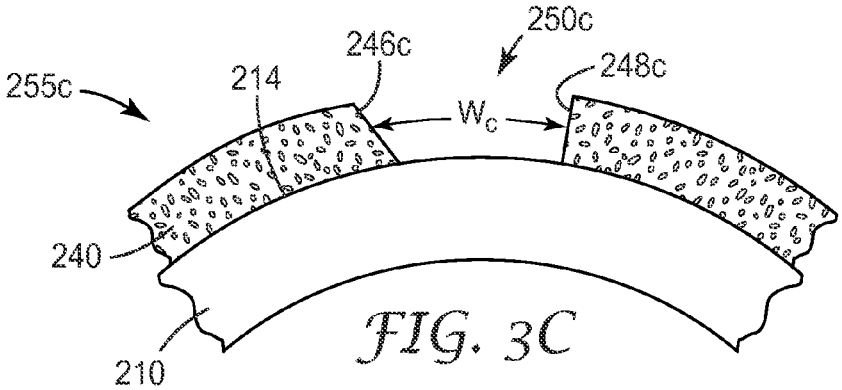
Figure 3D:
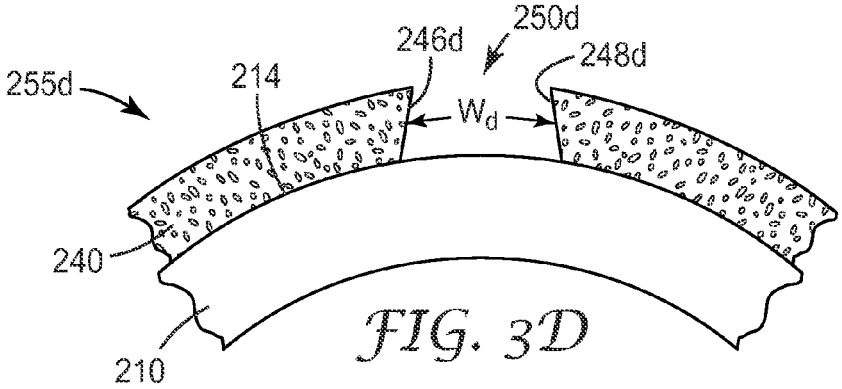

FIG. 2C shows a cross-sectional schematic of a compressed end gap region 235 of FIG. 2B, according to one aspect of the disclosure. Each of the numbered elements 210-250 in FIG. 2C corresponds to like numbered elements 210-250 presented in FIGS. 2A-2B, and both the description and the function of each element are correspondingly alike. In FIG. 2C, the compressed end gap region 235 includes the compliant layer 240 having a first thickness "$t_{c1}$" at first edge 246, and a second thickness "$t_{c2}$" at second edge 248, separated by gap 250 having a width "W". The polymeric film 220 is attached to the compliant layer 240 by second adhesive layer 249, and wrapped around open gap film roll core 200. Compliant layer 240 (initially at compliant layer thickness "$t_c$") is compressed to the first thickness "$t_{c1}$" by compressive forces imparted by the web tension, described elsewhere. The resulting compressed first thickness "$t_{c1}$" is less than second thickness "$t_{c2}$" (also compressed by the web tension), and also less than compliant layer thickness "$t_c$". The compression of the compliant layer 240 in the vicinity of the gap 250 results in the first wrap overlap 224 smoothly spanning the gap 250 and the starting edge 222 of polymeric film 220 placed in the gap 250.

FIGS. 3A-3D shows enlarged embodiments of an end gap region 255 of FIG. 2A, according to one aspect of the disclosure. In FIGS. 3A-3D, the end gap region (255*a*, 255*b*, 255*c*, 255*d*) includes a first edge (246*a*, 246*b*, 246*c*, 246*d*) and a second edge (248*a*, 248*b*, 248*c*, 248*d*) of compliant layer 240 that are cut at different angles relative to the outside surface 214 of cylindrical tube 210. In some cases, the angle cuts can influence the ability of the compliant layer to compress and even out the polymer layer (shown in FIGS. 2B-2C) spanning the gap (250*a*, 250*b*, 250*c*, 250*d*) and overlaying the starting end (also shown in FIGS. 2B-2C). Each of the gaps include a respective gap width (Wa, Wb, Wc, Wd) that can be defined by, for example, the average width of the gap or a minimum width of the gap, or some other representative dimension.

Figure 4A:
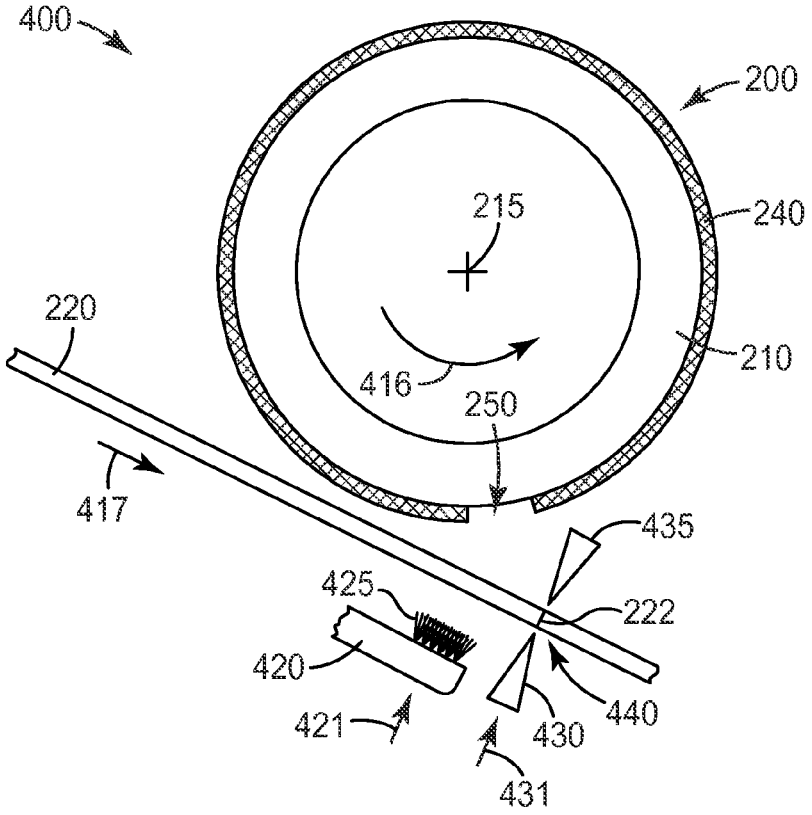
FIGS. 4A-4B shows a schematic of a web attachment technique.
Figure 4B:
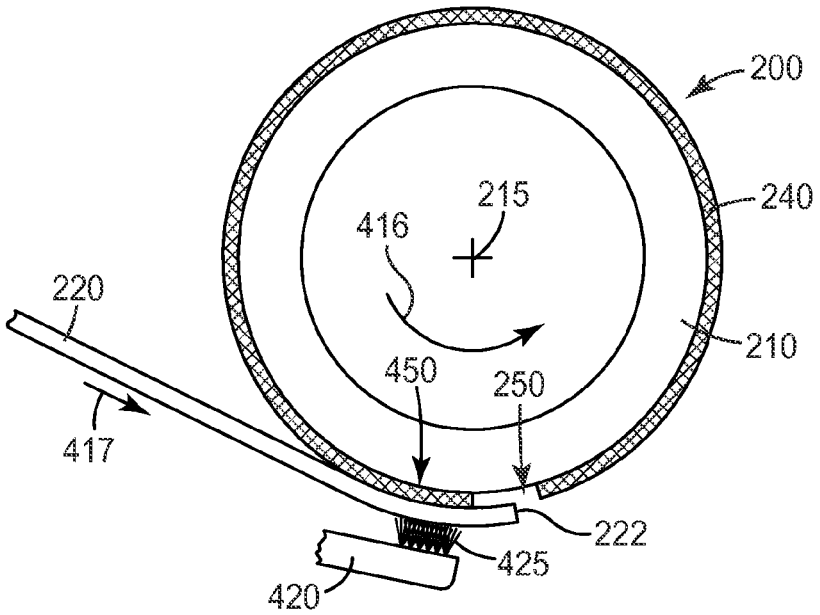

FIGS. 4A-4B shows a schematic of a web attachment technique 400 for an open gap film roll core 200, according to one aspect of the disclosure. Each of the numbered elements 210-250 in FIGS. 4A-4B corresponds to like numbered elements 210-250 presented in FIGS. 2A-2B, and both the description and the function of each element are correspondingly alike. In FIG. 4A, the open gap film roll core 200 includes a compliant layer 240 wrapped around cylindrical tube 210 leaving a gap 250. Open gap film roll core 200 rotates around central axis 215 in rotation direction 416, and a polymeric film 220 is disposed tangentially adjacent the open gap film roll core 200. The polymeric film 220 moves in a film direction 417, and the open gap film roll core 200 rotates such that the gap 250 and polymeric film 220 approach each other.

A cut step includes a knife-edge slitter 440 comprising a fixed knife 435 and a moving knife 430 that are positioned at a starting edge 222 that will be the slit position. The starting edge 222 slit position can be predetermined by a timing device (not shown) to be appropriate for disposing a cut edge in the gap 250. A transfer step includes a transfer device comprising a transfer support 420 and a brush 425 which are positioned to transfer the cut polymeric film 220 to the compliant layer 240 upon moving in the transfer direction 421. In some cases, the brush 425 can include a plurality of bristles, such as compliant rubber, polymeric, inorganic, or organic bristles, or at least one compliant flap, such as a rubber flap, or a polymeric flap.

Both the cut step and the transfer step are timed relative to the speed and rotation direction 416 of the open gap film roll core 200, the speed and film direction 417, and the position of the gap 250. In one particular embodiment, FIG. 4B shows the end of the cut and transfer step, where the fixed knife 435 and the moving knife 430 have severed the film producing starting edge 222 (after severing the film, the knife edge slitter is rapidly moved out of the way), which is deposited in the gap 250 by the transfer brush 425 on the transfer support 420. As soon as the starting edge 222 is disposed in the gap 250 and the transfer brush 425 presses the polymeric film 220 against the compliant layer 240 in a region having an adhesive layer 450, the transfer device is also rapidly moved out of the way. In one particular embodiment, the transfer brush 425 can be attached to the moving knife 430 so the cut and transfer is done with one fluid motion.

Figure 4C:
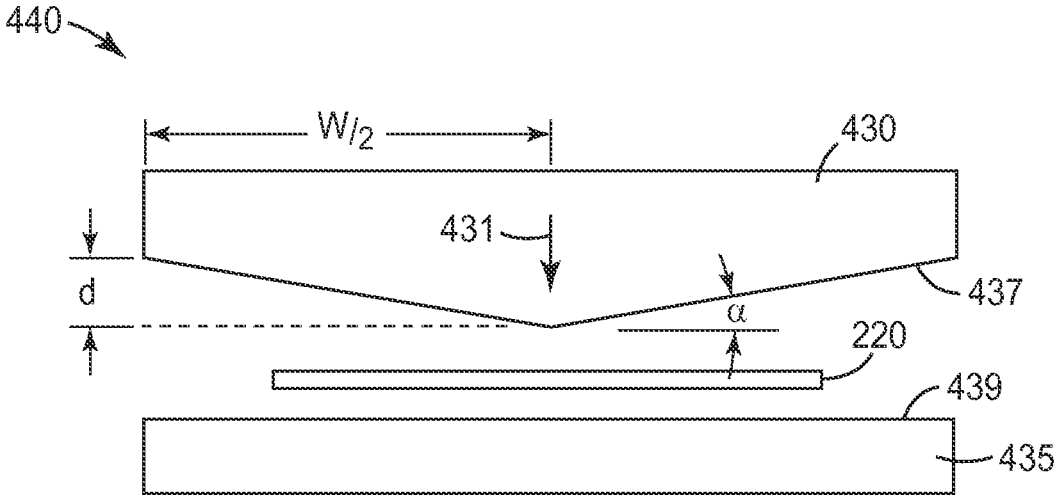
FIG. 4C shows a cross-sectional view of a knife for severing a web.

It will be appreciated that in order to precisely position the starting edge 222 of the severed polymeric film 220 in the gap 250, the timing of the cut and transfer operation should be precisely controlled. In addition, the cutting operation should be both accurate and repeatable, especially at the high speeds encountered in typical web processing (in excess of 500 feet/min (152 m/min)) In one particular embodiment, FIG. 4C shows a cross-sectional view of a knife-edge slitter 440 for severing a polymeric film 220 quickly and accurately, according to one aspect of the disclosure. Knife-edge slitter 440 includes a moving knife 430 capable of rapid motion in knife direction 431, and a fixed knife 435 having a static knife edge 439. Moving knife 430 includes a moving knife edge 437 that is in the shape of a "vee" with the center of the "vee" approximately centered over the polymeric film 220. The "vee" of the moving knife edge 437 includes an angle "a" that is much smaller than 1 degree, and can result in a draft distance "d" of about 0.125 inches (3.175 mm) over a knife width "w" of 60 inches (1524 mm) or more.

EXAMPLES

A Faustel winder (Faustel, Germantown Wis.) was modified with a new cut and transfer system. This cut and transfer system used a pivoting knife to cut the web as it passed through a gap that was bounded by the core and a back up blade. The cores were 6 inch (15.24 cm) I.D. by 7 inch (17.78 cm) O.D. fiber cores. The cores were wrapped with a 3M™ Cushion-Mount™ Plus Plate Mounting Tape E1040 (40 mil (1.016 mm)+2 mil (0.0508 mm) adhesive) foam tape.

The seam between the ends of the foam sheet created a ¼ inch (6.35 mm) wide gap. The cut and transfer knife actuation was synchronized with the core gap as it rotated so the starting end of the web was precisely positioned in the gap created. The transfer brushes pressed the web to the tacky foam covered core to start the winding process. The foam sheet on the core compressed at the gap where the starting end of the web was placed. This compression reduced the stress concentration normally created at this point, and as a result reduced the amount of core impressions on the adjacent web layers, thus reducing waste.

A Simatic S7-400 PLC (Siemens, Johnson City, Tenn.) was used to calculate a Knife Fire Offset based on the parameters of Line Speed, Scribe Offset, Knife Load Setting and Communications Delay. The Knife Fire Offset was sent to the appropriate Siemens MC servo drive and was compared to the actual position of the servo motors sine encoders. When the compare was true the drive energized the solenoid valve via high speed output. This action caused an air cylinder to extend, thereby releasing the catch for the mechanically powered knife.

Parameter Definitions

Scribe Offset: The Laser Scribe was set on top of the outboard spindle for operator access, such that when the outboard spindle was rotated to the transfer position, the core gap was at the bottom. If the Knife is fired and the spindle and web are at a standstill the film would be pasted to the new core. The distance from the leading edge of the pasted film on the new core to the core gap is the "scribe offset".

Knife Fire Offset: There were four different amounts of mechanical loading for the knife (Knife Load Setting). The amount of loading determined the amount of delay time for the knife fire. On the lower settings, the knife moved more slowly, however the mechanical catch was easier to overcome by the air cylinder, because there is less force on the catch.

Line Speed: As Line Speed was increased, the web and new core were moving at faster rates, so the Knife Fire Offset was increased exponentially to compensate for the faster rates.

Communications Delay: This included four different areas: (1) the processing time required for the Drive to turn on the output to the Control Relay; (2) the time it takes the Control Relay to close after the signal is received from the Drive; (3) the time it takes for the Solenoid to open the Air passage to the Cylinder; and (4) the time it takes for the Cylinder to produce enough force to overcome the resistance of the latch.

Operation of Cut and Transfer:

An operator installed a new core and turned on the Laser Scribe. The operator then aligned the core gap with the Laser Scribe. The Laser Scribe was turned off, and the Motor Sine Encoder was set to 0 (that is, the Core Gap position was at the 0 position). The prepared roll was then moved to the splice position and the other parts of the mechanical apparatus were moved to the correct positions. The prepared roll was then started and its surface speed was ramped to precisely the same speed as the linear speed of the moving web. Once the prepared roll was at the correct speed, the PLC sent the appropriate drive the calculated Knife Fire Offset. The PLC/drive then determined the fire position based on the Knife Fire Offset. When the position of the Motor Sine Encoder was equal to the knife fire position, the drive output energized the Control Relay and Solenoid Valve to release the stored energy in the knife mechanism. When the knife cut the web at the correct position, the brush placed the cut end of the web in the core gap.

Following are a list of embodiments of the present disclosure.

Item 1 is a film roll core, comprising: a cylindrical tube having an outer surface; a compliant layer disposed on the outer surface; and a longitudinal gap in the compliant layer, the longitudinal gap having a gap width sufficient to position a film edge within the longitudinal gap.

Item 2 is the film roll core of item 1, wherein the compliant layer is adhered to the outer surface.

Item 3 is the film roll core of item 1 or item 2, further comprising an adhesive disposed on at least a portion of an exterior surface of the compliant layer.

Item 4 is the film roll core of item 1 to item 3, wherein the longitudinal gap is parallel to a rotation axis of the cylindrical tube.

Item 5 is the film roll core of item 1 to item 4, wherein the longitudinal gap comprises a spiral.

Item 6 is the film roll core of item 1 to item 5, wherein the compliant layer comprises an open-cell foam or a closed-cell foam.

Item 7 is the film roll core of item 1 to item 6, wherein the compliant layer comprises a polyurethane, a polyethylene, a silicone, or a rubber.

Item 8 is the film roll core of item 1 to item 7, wherein the longitudinal gap includes a cross-section that comprises a rectangular shape, a tapered shape, a vee-shape, an inverted vee-shape, or a combination thereof.

Item 9 is the film roll core of item 1 to item 8, wherein the longitudinal gap includes a gap width that ranges from about 1/16 inch (1.5875 mm) to about 1/2 inch (12.7 mm)

Item 10 is the film roll core of item 1 to item 9, wherein the compliant layer has an uncompressed thickness that ranges from about 0.01 inches (0.254 mm) to about 0.06 inch (1.524 mm)

Item 11 is the film roll core of item 1 to item 10, wherein the longitudinal gap includes a gap width about 1/4 inch (6.35 mm) and the compliant layer has an uncompressed thickness of about 0.04 inches (1.016 mm)

Item 12 is a film winding apparatus, comprising: a film roll core having: an outer surface;

a compliant layer disposed on the outer surface; a longitudinal gap in the compliant layer having a gap width sufficient to accommodate a film edge; and a cut and transfer system capable of cutting a film substrate and transferring a severed edge of the film into the longitudinal gap, wherein the film substrate is disposed tangentially adjacent the outer surface, and the film substrate width is substantially parallel to a central axis of the film roll core.

Item 13 is the film winding apparatus of item 12, wherein the cut and transfer system comprises a knife edge slitter disposed to sever the film substrate and a transfer device capable of transferring the severed edge of the film substrate into the longitudinal gap.

Item 14 is the film winding apparatus of item 12 or item 13, wherein the film substrate is capable of moving relative to the film roll core, and the film roll core is capable of rotation about the central axis.

Item 15 is the film winding apparatus of item 12 to item 14, further comprising a timing device capable of precisely timing the cutting and transfer of the severed edge into the longitudinal gap while both the film substrate and the film roll core are moving.

Item 16 is the film winding apparatus of item 12 to item 15, wherein the film substrate width of the severed edge can be positioned entirely within the longitudinal gap.

Item 17 is the film winding apparatus of item 12 to item 16, wherein the transfer device comprises a brush having a plurality of bristles, or at least one compliant flap.

Item 18 is the film winding apparatus of item 12 to item 17, wherein the compliant layer further comprises an exterior adhesive layer.

Item 19 is a method of winding film, comprising: disposing a film substrate tangentially adjacent to a film roll core, the film roll core comprising: an outer surface; a compliant layer disposed on the outer surface; a longitudinal gap in the compliant layer having a gap width sufficient to accommodate a film edge; moving the film substrate past the film roll core; rotating the film roll core about a central axis such that the longitudinal gap and the film substrate approach each other; activating a knife edge slitter to sever the film substrate, thereby forming a severed film edge along a width of the film substrate; and activating a transfer device to dispose the severed film edge into the longitudinal gap.

Item 20 is the method of item 19, wherein the transfer device presses the film substrate to the compliant layer.

Item 21 is the method of item 19 or item 20, wherein the transfer device comprises a brush having a plurality of bristles, or at least one compliant flap.

Item 22 is the method of item 19 to item 21, wherein activating the knife edge slitter and the transfer device are timed relative to the rotation of the film roll core such that the severed film edge is positioned into the longitudinal gap and a major surface the film substrate contacts the compliant layer essentially simultaneously.

Item 23 is the method of item 19 to item 22, wherein the knife edge slitter comprises a pivoting knife edge slitter.

Item 24 is the method of item 19 to item 23, wherein the compliant layer further comprises an adhesive exterior layer.

Item 25 is a roll of film, comprising: a film core comprising: a cylindrical tube having an outer surface; a compliant layer disposed on the outer surface; a longitudinal gap in the compliant layer; and a web of film wound around the film core, wherein a first film edge of the web of film is disposed within the longitudinal gap such that subsequently wound layers of the web of film include minimal impressions of the first film edge.

Unless otherwise indicated, all numbers expressing feature sizes, amounts, and physical properties used in the specification and claims are to be understood as being modified by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A film roll core, comprising:

a cylindrical tube having an outer surface;

a compliant layer disposed on the outer surface and having an initial thickness, $t_c$; and a longitudinal gap in the compliant layer, the longitudinal gap defined by a first edge of the compliant layer and a second edge of the compliant layer, the first edge and a the second edge separated by a gap width, W, sized to accommodate a starting end of the film, the gap width between about 1/16 inches (1.588 mm) and about 3/8 inches (9.25 mm), wherein the first edge of the compliant layer is compressed to a first thickness, $t_{c1}$, when a web of film is wound around the film roll core, wherein the second edge of the compliant layer is compressed to a second thickness, $t_{c2}$, when the web of film is wound around the film roll core, wherein the first thickness, $t_{c1}$, is less than second thickness, $t_{c2}$, and wherein the first thickness, $t_{c1}$, is less than the initial thickness, $t_c$.

2. The film roll core of claim 1, wherein the compliant layer is adhered to the outer surface.

3. The film roll core of claim 1, further comprising an adhesive disposed on at least a portion of an exterior surface of the compliant layer.

4. The film roll core of claim 1, wherein the longitudinal gap is parallel to a rotation axis of the cylindrical tube.

5. The film roll core of claim 1, wherein the longitudinal gap comprises a spiral.

6. The film roll core of claim 1, wherein the compliant layer comprises an open-cell foam or a closed-cell foam.

7. The film roll core of claim 1, wherein the compliant layer comprises a polyurethane, a polyethylene, a silicone, or a rubber.

8. The film roll core of claim 1, wherein the longitudinal gap includes a cross-section that comprises a rectangular shape, a tapered shape, a vee-shape, an inverted vee-shape, or a combination thereof.

9. A roll of film, comprising:

a film core comprising:

a cylindrical tube having an outer surface;

a compliant layer disposed on the cylindrical tube outer surface and having an initial thickness, $t_c$;

a longitudinal gap in the compliant layer defined by a first edge of the compliant layer and a second edge of the compliant layer, the longitudinal gap having a gap width between about 1/16 inches (1.588 mm) and about 3/8 inches (9.25 mm); and a web of film wound around the film core, wherein a first film edge of the web of film is disposed within the longitudinal gap, wherein the first edge of the compliant layer has a first thickness, $t_{c1}$, due to compressive forces imparted by the web of film wound around the film core, wherein the second edge of the compliant layer has a second thickness, $t_{c2}$, due to the compressive forces imparted by the web of film wound around the film core, wherein the first thickness, $t_{c1}$, is less than second thickness, $t_{c2}$, and wherein the first thickness, $t_{c1}$, is less than initial thickness, $t_c$.

* * * * *